US005419391A

United States Patent [19]

Chan et al.

[11] Patent Number: 5,419,391

[45] Date of Patent: May 30, 1995

[54] STEAM GENERATOR WITH AXIAL FLOW PREHEATER

[75] Inventors: King W. Chan, Lutz; Daniel E. Ford, Cantonment, both of Fla.; Robert M. Wilson, Plum Boro, Pa.

[73] Assignee: Westinghouse Electric Corporation, Pittsburgh, Pa.

[21] Appl. No.: 900,518

[22] Filed: Jun. 17, 1992

Related U.S. Application Data

[63] Continuation of Ser. No. 680,880, Apr. 5, 1991, abandoned.

[51] Int. Cl.[6] ..... F28F 9/22

[52] U.S. Cl. ..... 165/159; 122/32

[58] Field of Search ..... 165/159, 160, 161, 162; 122/32, 33

[56] References Cited

U.S. PATENT DOCUMENTS

| | | | |
|---|---|---|---|
| 2,411,097 | 11/1946 | Kopp | 165/158 |
| 2,655,350 | 10/1953 | Gaylord, Jr. | 165/160 |
| 2,919,903 | 1/1960 | Vautrain et al. | 165/161 |
| 3,267,693 | 8/1966 | Richardson et al. | 165/160 |
| 3,706,301 | 12/1972 | Penfield, Jr. | 165/161 |
| 3,804,069 | 4/1974 | Bennett | 122/34 |
| 3,807,365 | 4/1974 | Lyman et al. | 122/32 |
| 3,811,498 | 5/1974 | Ferraro et al. | 165/161 |
| 3,841,272 | 10/1974 | Mayer et al. | 165/159 |
| 3,896,770 | 7/1975 | Byerley et al. | 122/32 |
| 3,916,841 | 11/1975 | Schroder et al. | 122/32 |
| 3,916,843 | 11/1975 | Bennett | 122/32 |
| 3,942,481 | 3/1976 | Bennett | 122/32 |
| 4,046,110 | 9/1977 | Fritz et al. | 122/32 |
| 4,120,350 | 10/1978 | Norton | 122/32 |
| 4,204,502 | 5/1980 | Forestier et al. | 122/32 |
| 4,308,914 | 1/1982 | Ruhe et al. | 122/32 |
| 4,357,908 | 11/1982 | Yazidjian | 122/32 |
| 4,498,426 | 2/1985 | Leroy et al. | 122/32 |
| 4,554,889 | 11/1985 | Lilly | 122/32 |
| 4,573,526 | 3/1986 | Jung | 165/159 |
| 4,576,222 | 3/1986 | Granata, Jr. et al. | 165/159 |
| 4,579,088 | 4/1986 | Kim, Jr. et al. | 165/159 |
| 4,633,940 | 1/1987 | Gentry et al. | 165/159 |
| 4,736,713 | 4/1988 | Roarty | 122/32 |

*Primary Examiner*—John Rivell
*Assistant Examiner*—L. R. Leo

[57] ABSTRACT

An improved heat exchanger utilizing a primary heated fluid to vaporize a secondary fluid flowing axially therethrough including a preheater assembly located within a cold leg side of the heat exchanger to allow axial flow of the secondary fluid through a preheater assembly to heat the secondary fluid to it boiling point temperature. The heat exchanger generally comprises a vertical shell portion with a tubesheet disposed adjacent a lower end thereof and a tube bundle which includes a plurality of U-shaped tubes through which the primary fluid flows. The preheater assembly is located in the vicinity of the tubesheet wherein the secondary fluid enters the preheater through a fluid inlet nozzle into a lower feedwater inlet box which is disposed around the inlet nozzle for dispersing the secondary fluid from the nozzle over a greater area. Specifically, the feedwater inlet box may include a double-perforated plate assembly whose flow resistance produces a low velocity uniform introduction of feedwater into the tube bundle. This water flows upward providing axial-counter flow and enhances heat transfer. This cold water is introduced near the coldest end of the tubes where it is most effective, while the design prevents thermal shock of the tubesheet with a layer of warm recirculating water providing a cushion between the tubesheet and the cold feedwater.

22 Claims, 5 Drawing Sheets

STEAM GENERATOR WITH AXIAL FLOW PREHEATER

This application is a continuation of application Ser. No. 07/680,880 filed Apr. 5, 1991, abn.

FIELD OF THE INVENTION

This invention generally relates to steam generators for nuclear power plants, and is specifically concerned with an axial flow preheater or economizer for improving the efficiency of such a steam generator.

BACKGROUND OF THE INVENTION

Steam generators utilizing a heated primary fluid to produce steam from a secondary fluid have been used in nuclear power plants for a number of years. In such a steam generator the pressure of the steam is a function of the log mean temperature difference (LMTD) of the two fluids. The LMTD equation for a countercurrent flow heat exchanger is:

$$LMTD = \frac{(T_1' - T_1'') - (T_2' - T_2'')}{\ln\left(\frac{T_1' - T_1''}{T_2' - T_2''}\right)}$$

where $T_1'$ and $T_1''$ are the temperatures of the entering first and second fluids, respectively and $T_2'$ and $T_2''$ are the temperatures of the exiting first and second fluids, respectively, from the heat exchanger. If the flow pattern in the exchanger is not completely countercurrent or cocurrent, as in a U-tube heat exchanger, it is necessary to apply a correction factor. This equation does not include such a correction factor and is merely provided as an example. By increasing the LMTD the pressure of the steam can be increased. However, the temperature of the primary fluid is a limiting factor in a nuclear power plant because it is normally set at a maximum allowable value. Therefore, preheater or economizer chambers incorporated within the steam generator housing are important in providing an increased LMTD without requiring an increased primary fluid temperature. U.S. Pat. No. 3,804,069 issued to Bennett and assigned to Westinghouse Electric Corp., the assignee of the present invention, provides an example of a steam generator which includes a preheater located within the generator housing to raise the temperature of the secondary fluid to the boiling temperature thereof. The efficiency of the steam generator is improved by the operation of the preheater in rapidly raising the temperature of the secondary fluid to nearly that of the primary fluid.

Prior art preheaters presently used in steam generators generally use a laterally directed cross-flow system of heat transfer to maximize heat transfer in a limited amount of space. FIG. 1, set forth in more detail hereinafter, illustrates a steam generator wherein feedwater enters the generator through a nozzle and is directed back and forth across the cold leg side of a lower tube bundle section. However, due to the relatively high velocity of incoming secondary fluid which flows perpendicular to the tubes within each cross-flow path, current preheaters have potential to cause these tubes to vibrate. The resulting vibration of the heat exchanger tubes in the cold leg side of the generator causes them to strike against the support plates that laterally secure them, which might cause the walls of these tubes to wear. Such tube wall wear can in turn cause some leakage of the primary fluid that flows through the heat exchanger tubes to mix with the non-radioactive water secondary fluid that is ultimately used to create non-radioactive steam, thereby contaminating it. Consequently, the tube vibration that can potentially be produced by the lateral, back and forth flow pattern associated with prior art crossflow preheaters is undesirable.

Other drawbacks associated with such prior art preheaters result from the channeling of cold secondary feedwater near the base of the steam generator in the vicinity of the tubesheet and lower part of the tube bundle. The channeling of such cold feedwater onto the tubesheet results in unwanted thermal stresses to the lower shell and the tubesheet. Additionally, if the colder feedwater contacts saturated steam in the tube bundle, it can quench the steam, causing instantaneous steam collapse or water hammer. Water hammer conditions not only introduce unwanted mechanical shocks to the generator, but also produce undesirable water level fluctuations in the generator. Finally, the space required by some prior art preheaters within the shell of the steam generator displaces some of the U-shaped heat exchanger tubes that could otherwise be present, which lowers the overall efficiency of the generator.

To alleviate these latter drawbacks, systems have been designed to reduce the thermal stresses experienced by the tubesheet by splitting the flow of the incoming colder secondary water so only a limited amount of water is allowed to come in contact with the tubesheet as set forth in U.S. Pat. No. 3,896,770 issued to Byerley et al. Unfortunately, such preheater arrangements still may produce tube vibration. A second method is to provide a buffer zone adjacent to the tubesheet to protect the tubesheet from thermal shock, as set forth in U.S. Pat. Nos. 3,942,481 and 3,916,843 issued to Bennett. However, the baffle plates of the steam generator restrict service access to the cold leg areas of the tube bundle and introduce new sites where tube degradation may take place.

Clearly, a heat exchanger assembly is needed which can be incorporated into the steam generator in nuclear power plant facilities that reduces the potential for tube vibration present in cross-flow preheater systems while also providing a means of protecting the tubesheet and tube bundle from thermal shock stresses caused by contact with cold secondary fluid that maximizes the space available for exchanger tubes in the tube bundle.

SUMMARY OF THE INVENTION

Generally, the invention in its broadest sense includes an improved heat exchanger which includes a primary heated fluid to vaporize a secondary fluid flowing axially therethrough including a preheater assembly which is separated from the hot leg side of the exchanger and which redirects the transversely oriented flow of the secondary fluid into an axial flow to heat the secondary fluid to its boiling point temperature.

The heat exchanger of the present invention is preferably utilized in a steam generator and is comprised of a vertical shell portion for enclosing the secondary fluid with a tubesheet disposed adjacent to a lower end thereof. A tube bundle of substantially parallel heat exchanger tubes is disposed in thermal communication with the contained secondary fluid through which the primary fluid flows. The tube bundle consists of inverted, vertical U-tubes. These include a group of hotter ends of the heat exchanger U-tubes forming a hot leg side and a group of cooler tube ends forming a cold leg side. Further, the generator includes a plurality of foraminous tube support plates disposed at axial locations within said shell portion.

The preheater assembly is located in the vicinity of the tubesheet wherein the secondary fluid enters the preheater through a fluid inlet nozzle and flows transversely through a flow inlet box with respect to the cold leg side. The preheater assembly is capable of redirecting the transverse flow of the secondary fluid into an axial flow that is substantially parallel to the longitudinal axes of the tubes of the cold leg side. The secondary fluid within the preheater assembly may be maintained separate from the hot leg side of the generator by a plurality of center partitions integrally positioned upon the top and bottom of each of the tube support plates. Therefore, standard whole tube support plates may be used throughout the shell of the generator. Moreover, because the heat transfer to the fluid is accomplished by axial flow of the fluid over the cold leg portion of the tube bundle, the potential for tube vibration is substantially reduced.

A lower tube support plate defines the lower boundary of the preheater assembly and is designed in accordance with the present invention to allow only a minimal amount of secondary fluid to leak therethrough forcing a majority of the fluid to flow axially upward through the preheater. The lower tube support plate may also be spaced sufficiently above the tubesheet to allow a flow distribution plate to be placed therebetween. The flow distribution plate is designed such that a slow flow zone at the tubesheet is at or very near to a tube lane where a blowdown inlet can be located which is centrally placed between the hot leg side and cold leg side.

A flow inlet box is disposed around the inlet nozzle for dispersing the transversely oriented flow of the secondary fluid from the nozzle over a greater area. Specifically, the flow inlet box may include a double-perforated plate assembly which is located before the outlet to the box. The first perforated plate is designed to substantially reduce the inlet flow velocity and to force the entering feedwater into a broad distribution within the flow inlet box. The second plate is designed to diffuse the feedwater into localized jets to provide a smooth low velocity flow of feedwater, evenly diffused into the cold leg side of the tube bundle for preheating. The flow inlet box is located at the lower end of the generator so that the greatest primary to secondary temperature difference can be achieved and because the tubes are stiffest and most able to accept crossflow near the tubesheet. Warm recirculating water, which flows within an annular passage located between the wrapper and the shell, can pass between the wall of the flow inlet box and the shell and enter the generator at the tubesheet just below the discharge zone of the feedwater.

Thermal shock to the tubesheet caused by the feedwater contact is prevented by creating a cushion of warm recirculating water because of the precise placement of the flow inlet box above the tubesheet and the sizing of the annular space defined between the wrapper and the shell so that recirculating water flowing under the distribution box serves to insulate the tubesheet from the cold feedwater. Such a design eliminates the need for a flow distribution baffle located below the preheater inlet above the tubesheet. Moreover, because of the distribution effects of the flow inlet box, most of the heat transfer efficiency can be achieved and the invention may be operated without the previously mentioned plurality of partition plates.

DETAILED DESCRIPTION OF THE INVENTION

Figure 1:
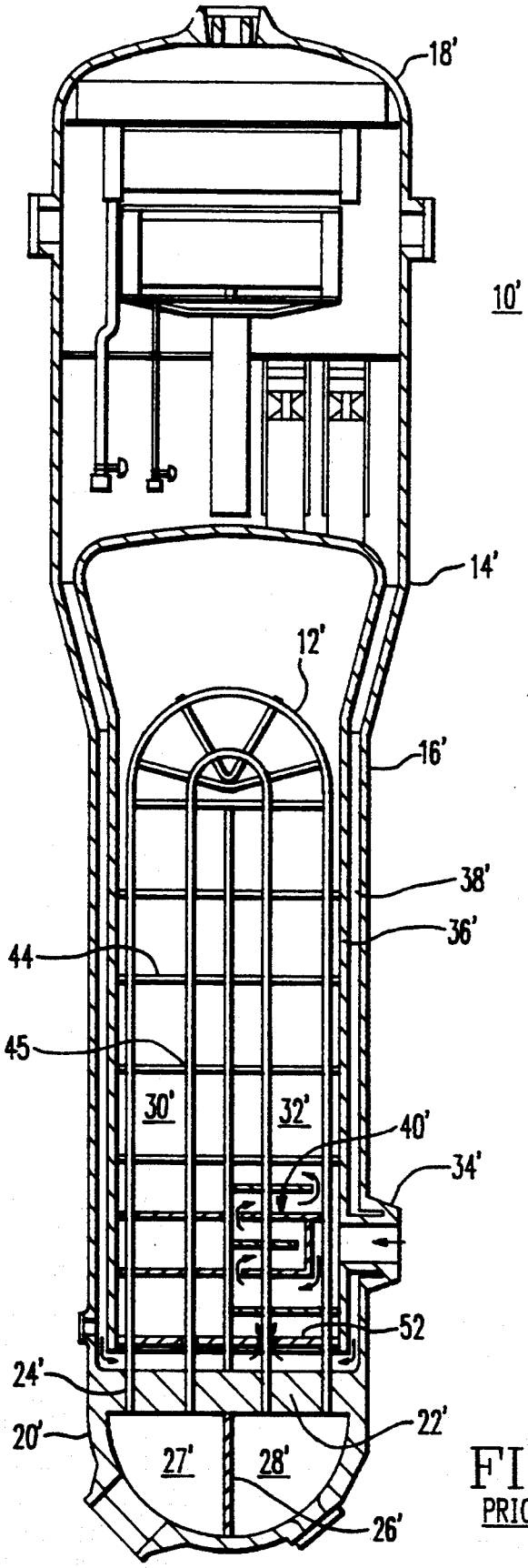
FIG. 1 PRIOR ART
FIG. 1 is a cross-sectional view of a typical 8 prior art steam generator which includes a cross-flow preheater.

With reference now to FIG. 1, wherein like numerals designate like components throughout all of the several figures, a steam generator 10' includes a U-shaped bundle of tubes 12' to provide the heat surface required to transfer heat from a primary fluid flowing within the tubes to vaporize or boil a secondary fluid flowing outside of the tubes. The steam generator 10' comprises a vessel 14' having a vertically disposed tubular shell portion 16' and an end closure or head 18' enclosing one end of the shell and a channel head 20', enclosing the other end of the shell. A tubesheet 22' is made integral with the channel head 20' and has a plurality of holes 24' disposed to receive the ends of the U-shaped tubes 12'. A divider plate 26' is centrally disposed within the channel head 20' and divides the channel head into two compartments 27' and 28' which serve as headers for the tubes 12'. The compartment on the left, as shown in FIG. 1, is the primary fluid inlet compartment 27' or hot leg portion, and the compartment on the right, as shown in FIG. 1, is the primary fluid outlet compartment 28', or cold leg portion, and has a primary fluid outlet nozzle (not shown) in communication therewith, thus causing the primary inlet fluid to flow through the tubes and thereby create a hot leg side 30', the portion shown on the left in the drawings, and a cold leg side 32', the portion shown on the right in the drawings. A tubelane 33' is located substantially in the center of the generator representing the space within the legs of the U-shaped heat exchanger tubes. A secondary fluid or inlet nozzle 34' is disposed in the lower portion of the shell 16', adjacent the tubesheet 22'. Tubes 12' are substantially surrounded by wrapper 36'. An annular flow path 38' is created between the outer wall of wrapper 36' and tubular shell portion 16' to allow recirculation fluid to flow therebetween.

The steam generator 10' also has a means for separating water or secondary fluid from the steam or vapor disposed in the upper portion or end closure 18'. For a more complete description of the upper portion of the steam generator, reference may be made to an earlier application filed, Feb. 9, 1972 and assigned Ser. No. 224,804, now U.S. Pat. No. 3,804,069. This application is assigned to the same assignee and is hereby incorporated by reference in this specification.

FIG. 1 illustrates a typical prior art cross flow preheater 40' located adjacent tubesheet 22'. As discussed in detail above, such a preheater is designed to raise the temperature of the secondary fluid to its boiling point temperature. Preheaters designed in such a cross-flow manner have been found to cause unwanted vibration of the tube bundle. Moreover, because of the complicated cross-flow baffles contained within the preheater section, service access to the legs of the U-shaped tubes in cold leg side 32' is restricted. This can increase maintenance costs and generator down time.

Figure 2:
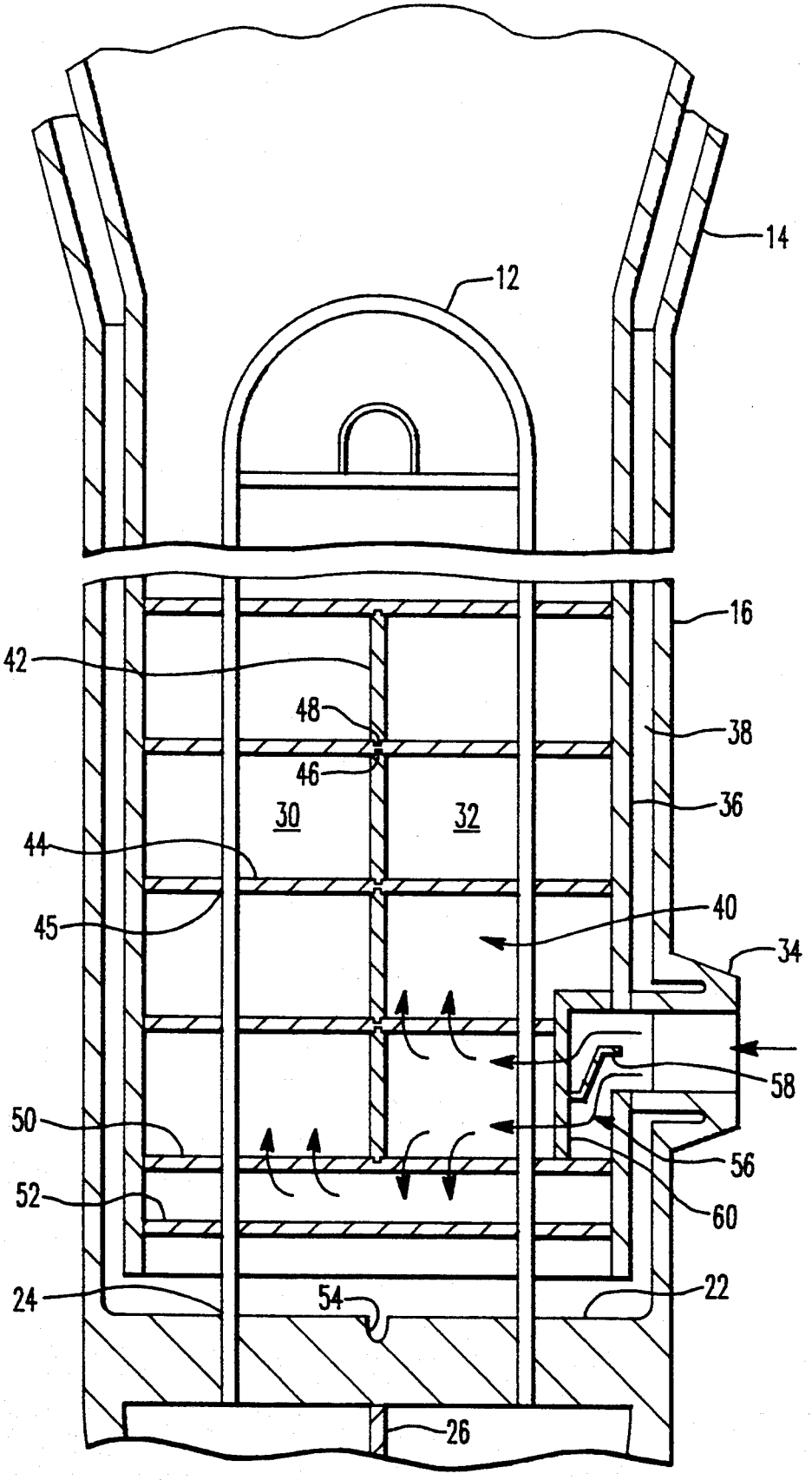
FIG. 2 is an enlarged partial cut-away cross-sectional view of a lower portion of the steam generator representing one embodiment of the present invention.

Referring now to FIG. 2, the benefits of the present invention become readily apparent. The upper portion of steam generator 10 is not shown but is designed similar to that which is described above for the steam generator illustrated in FIG. 1. Preheater 40 is located on the cold leg side 32 of tubes 12, as is preheater 40'. However, preheater 40 provides axial flow of the secondary fluid rather than cross-flow. This design reduces amount of unwanted vibration compared to the cross-flow designed preheaters. Secondary fluid enters the preheater 40 through inlet nozzle 34 wherein the flow is transversely oriented with respect to the longitudinal axes of tubes 12. Partition plates 42, located within tubelane 33, provide a means of redirecting the transversely oriented flow to a flow that is parallel to the longitudinal axes of tubes 12. The flow of secondary fluid in a parallel orientation allows the fluid to be preheated in the preheater portion 40 without causing a large amount of damaging vibration to the generator.

Specifically, partition plates 42 are preferably centered between tube support plates 44. Tube support plates are generally designed to provide lateral support and stabilization for the tubes 12 and generally include a plurality of horizontally disposed, vertically spaced plates which are fixedly secured to the interior surface of wrapper 36. As is conventional, tube support plates 44 are foraminous plates which provide limited lateral support and restricted movement of tubes 12, in response to the secondary fluid which flows within the tube bundle by providing flow passages therebetween. These passages may be broached holes depending upon the quantity of a fluid flow desired.

A major advantage provided by these partition plates is the manner in which they are supported between tube support plates 44. The tube support plates 44 are designed to include slots 46 which run along the diameter of the tube support plate on both the top and the bottom. The slots 46 matingly receive key extensions 48 projecting from partition plates 42. A conventional seal can be used to secure the partition plate to the tube support plate.

The partition plates 42 provide the preheater boundary between the hot leg side 30 and the cold leg side 32. Wrapper 36 defines the opposite boundary and provides an annular flow path 38 between wrapper 36 and shell portion 16. Preheaters designed in accordance with the present invention allow the use of regular full round tube support plates. Moreover, replacement or repair within the cold leg side of the tubes 12 is much easier because the preheater portion is substantially similar to the remaining tube bundle allowing greater access therein.

The partition plates 42 extend vertically within wrapper 36 to a distance sufficient to cause the secondary fluid to substantially reach its boiling point temperature. In some instances, this will require the preheater 40 to encompass a larger area than a cross-flow designed preheater, but the reduction in unwanted vibration which is normally associated with cross-flow preheaters makes such an increase advantageous. The lower boundary of preheater 40 may be defined by a lower tube support plate 50. Lower tube support plate 50 is preferably designed to allow a minimal amount of entering secondary fluid to leak therethrough to maximize the efficiency of the preheater. Preferably, at full load, less than 10% of the entering secondary fluid flow is allowed to leak through the lower tube support plate 50 to join the recirculation flow from annular flow path 38 and flow up the bundle of tubes 12 on the hot leg side 30. Lower tube support plate 50 preferably has round tube hole with a minimum tube to tube support plate clearance to provide a minimum flow area and high pressure drop, so that the leakage flow is minimized.

A preheater 40, as illustrated in FIG. 2, also allows the distance between lower tube support plate 50 and the tubesheet 22 to be much greater than a similar tube support plate found in the generator illustrated in FIG. 1. This added space provides enough space to include a flow distribution baffle 52 therebetween within wrapper 36. Such a distribution baffle is important to protect the tubesheet 22 from cyclic temperature excursions which are produced by thermal stresses that result from cold secondary fluid channeling along tubes 12 and contacting tubesheet 22. The flow distribution baffle 52 is cooperatively associated with the lower tube support plate 50 and tubesheet 22 to prevent the influent secondary fluid that is introduced into the preheater from channeling along tubes 12 and contacting the tubesheet. For a more complete description of possible flow distribution baffles, reference may be made to an earlier application, Jan. 15, 1974 and assigned Ser. No. 433,615, now U.S. Pat. No. 3,916,843. This application is assigned to the same assignee and is hereby incorporated by reference in this specification.

With a properly designed flow distribution baffle 52, a slow flow zone at tubesheet 22 will be at or very near to tube lane 33 where a blowdown inlet 54 can be located. In generators similar to that which is illustrated in FIG. 1, there may not be sufficient space below the lower tube support plate 50. When the lower tube support plate is too low, the slow flow zone created by the flow distribution baffle will be shifted into the hot leg side of the bundle of tubes where placement of the blowdown inlet will be difficult. Moreover, a number of the tubes would have to be eliminated to provide sufficient space. Generator 10 of the present invention allows the blowdown inlet to be located substantially between hot leg side 30 and cold leg side 32 allowing a maximum number of tubes 12 to be disposed within wrapper 36.

Inlet nozzle 34 is designed to include a flow inlet box 56 disposed around the inlet nozzle for dispersing the transversely oriented flow of the secondary fluid over a greater area. FIG. 2 provides a simple flow inlet box 56 which is only partially contained within annular flow path 38. The majority of box 56 is disposed within the wrapper 36 wherein a portion of the wrapper defines a lower wall of the box. Flow inlet box 56 is designed in this embodiment to include a channel separator 58 for substantially channeling the transversely oriented flow of the secondary fluid into at least two substantially equal flow paths. Each flow path is then directed through a perforated plate 60 to restrict the flow of the secondary fluid exiting box 56 and diffuse the fluid into localized jets so that the secondary fluid enters the preheater 40 in a more uniform manner to provide uniform heat transfer. The perforated plate 60 is also important to reduce the velocity of the entering secondary fluid so that is will not contact partition plates 42 at a velocity which could cause unwanted vibration of the generator as in cross-flow preheaters.

Figure 3:
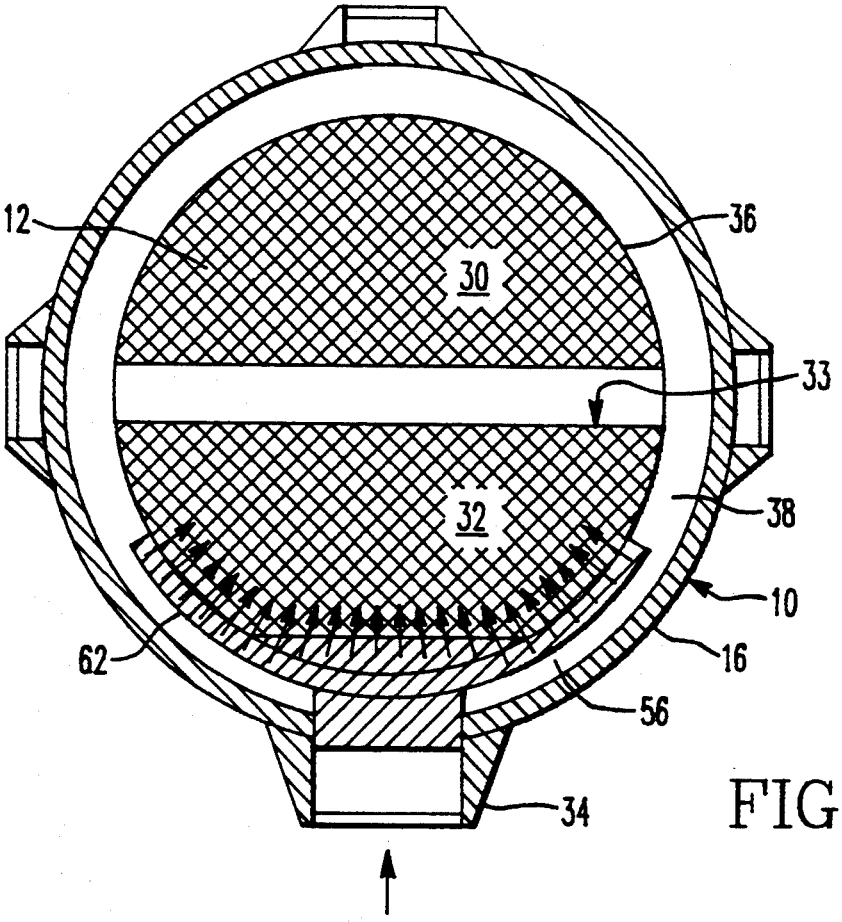
FIG. 3 is cross-sectional view of a second embodiment of the present invention.

Referring now to FIG. 3, a second embodiment of flow inlet box 56 is illustrated wherein the entire box is located within annular flow path 38. This design provides a greater area of heat transfer within the cold leg side of the generator and allows easier access to inlet box 56 without disturbing tubes 12. In this view, the curvature of inlet box 56 is clearly shown to accommodate the curvature of shell 16 and wrapper 36. Inlet box 56 is illustrated in FIG. 3 to encompass a 120° angular area. The inlet box may encompass any angular distance between 90° and 180°. As clearly shown in the figure, flow inlet box 56 causes the secondary fluid flow to enter the tube bundle in a substantially even flow distribution. This increases the heat transfer capabilities of the generator and also reduces the possibility of unwanted vibration because the tubes are stiffest near the tubesheet which would result from centralized entry of the secondary fluid at the nozzle. In addition, partition plates 42 become optional when the flow inlet box is designed in the manner set forth in FIG. 3. This substantially improves the ability for servicing the generator through hand holes 57 by eliminating the partition plates and thus clearing tubelane 33.

Figure 4:
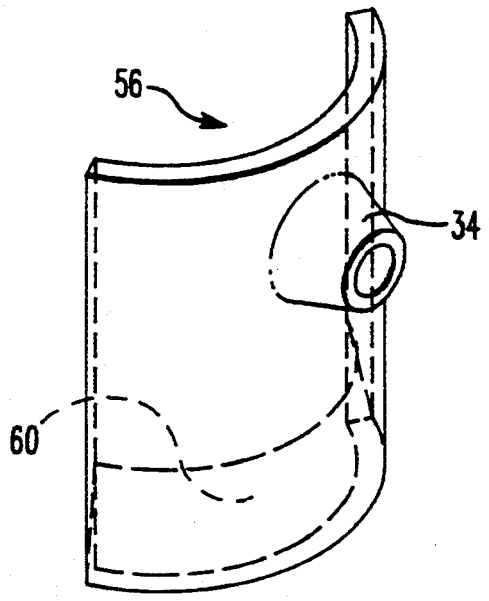
FIG. 4 is a perspective view of the flow inlet box of FIG. 3.

FIG. 4 provides an enlarged prospective view of flow inlet box 56. In this view, it is readily apparent that flow inlet box 56 can be an integral casing which includes the double perforated plate assembly explained in greater detail below.

Figure 5:
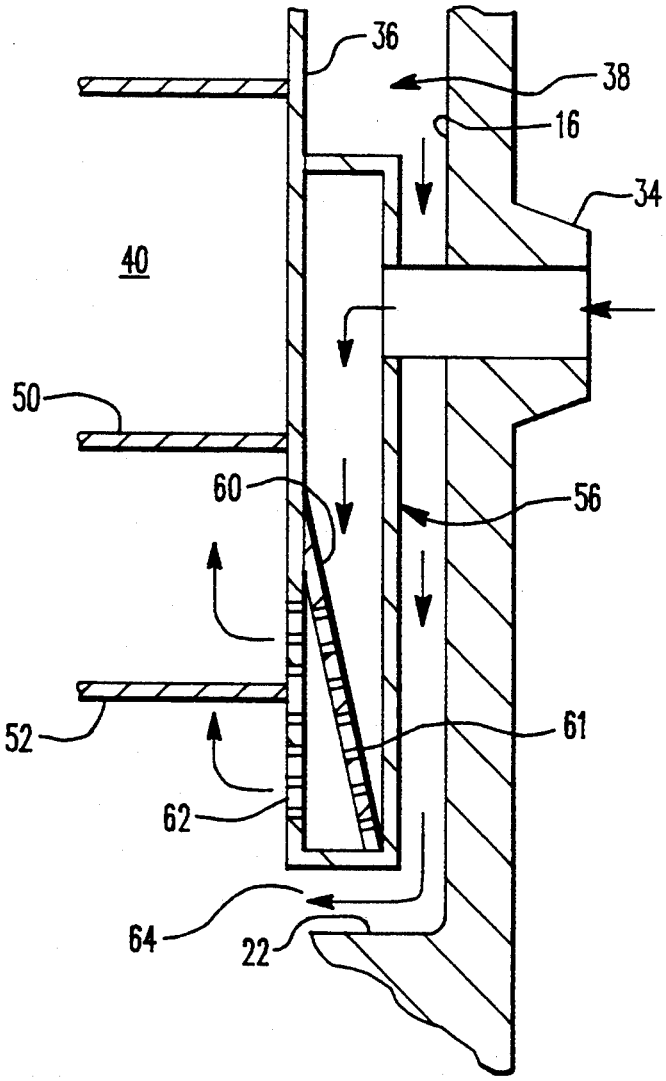
FIG. 5 is a close partial cut-away view of the embodiment of FIG. 3 illustrating a flow inlet box designed in accordance with the present invention.

FIG. 5 provides a cross-sectional view of flow inlet box 56 illustrated in FIG. 3 . In this embodiment, secondary fluid enters through inlet nozzle 34 at the lower end of the generator 10 on the cold leg side 32 of tubes 12. Flow inlet box 56 includes a first perforated plate 61 and a second perforated plate 62. The first perforated plate 61 is designed to provide a high resistance to the flow of entering secondary fluid by including only a limited number of perforations 63. Preferably, first perforated plate has a porosity of approximately 5%. This high resistance to flow forces the secondary fluid to distribute over the entire angular extent of flow inlet box 56. If this were not designed as such, the secondary inlet flow would primarily enter the generator at the center of the inlet box which could cause high local velocity and unwanted vibration to tubes 12. The angle at which first perforated plate 61 is placed within flow inlet box 56 is not critical. The second perforated plate 62 is essential to break up the small high velocity jets which exit the first perforated plate. Preferably, second perforated plate 62 is perforated to approximately 50% porosity to diffuse the secondary fluid entering the preheater into low velocity uniform flow. This allows the smooth flow of secondary fluid evenly diffused throughout the entire curvature of flow inlet box 56 into cold leg side 32 of the tubes 12.

In this embodiment thermal shock to tubesheet 22 caused by the feedwater coming in contact therewith is prevented by precise placement of the flow inlet box above the tubesheet and sizing of annular flow path 38. Without such a design, a flow distribution baffle or baffle plate is required, to restrict the amount of cooler secondary fluid which comes in contact with the tubesheet and lower shell portion to reduce the possibility of thermal stresses. These baffle plates restrict service access to the cold leg side of the tube bundle and form an intersection with the tubes which poses additional risk for tube degradation. However, in the present embodiment, inlet box 56 is placed to allow the warmer recirculating fluid flowing from annular flow path 38 to flow through passage 64 under inlet box 56. The recirculating fluid serves to "insulate" tubesheet 22 from the colder secondary fluid by preventing its contact with the tubesheet. In fact, the recirculating fluid which flows along the surface of tubesheet 22 acts as a cushion of warm water. In such an embodiment, flow distribution baffle 52 becomes optional because the tubesheet is sufficiently protected from thermal stresses by this cushion of warmth.

Another benefit of placing the inlet box near the tubesheet is that secondary fluid enters the generator and contacts the tube bundle at the stiff portion of tubes 12. Therefore, vibration of the tube bundle is reduced and thermal stresses to the tubesheet and lower shell portion are substantially eliminated by flow inlet box 56's placement.

Figure 6:
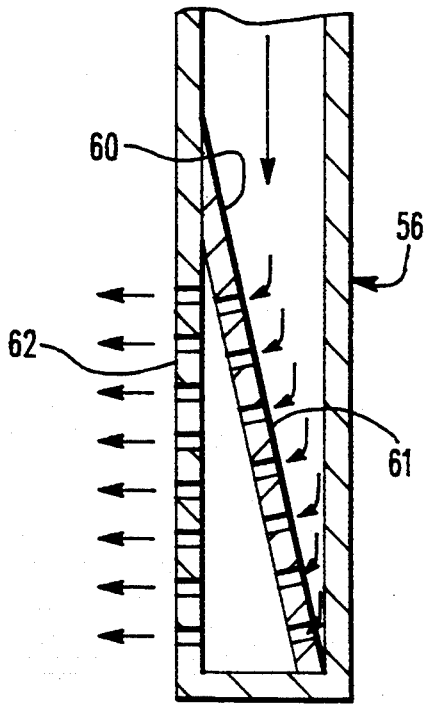
FIG. 6 is a cross-sectional view of the double perforated plate assembly of the flow inlet box as originally set forth in FIG. 3.

FIG. 6 provides an enlarged cross-sectional view of flow inlet box 56, as set forth above. FIG. 6 also more clearly shows the actions of first perforated plate 61 and second perforated plate 62 on the entering secondary fluid. Specifically, first perforated plate 61 provides a high resistance to flow because of the limited number of perforations 61, the second perforated plate 62 is required to break-up the high velocity liquid jets created by the first plate.

Figure 7:
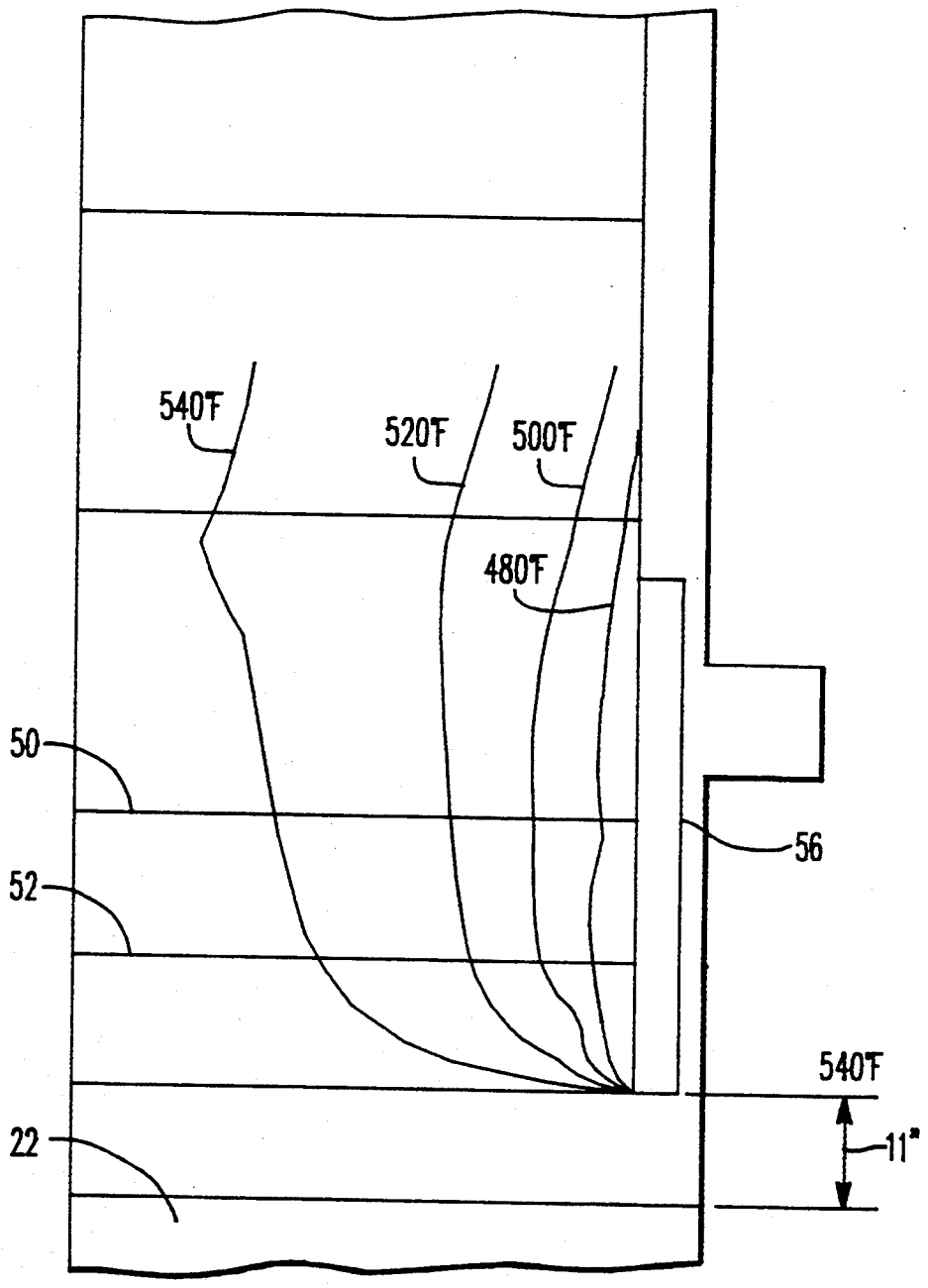
FIG. 7 is a temperature profile of secondary fluid entering a steam generator made in accordance with the present invention.

FIG. 7 provides a temperature profile for a steam generator which includes a flow inlet box 56 designed in accordance with the present invention. In each of the figures, it is clear that the flow of cooler secondary fluid is directed away from the tubesheet by the cushion of warmer recirculating fluid which flows along the surface of the tubesheet. In this figure it can be seen that flow distribution baffle 52 is not required to protect the tubesheet from thermal stresses and can be located in a position well above the tubesheet, if at all, to allow easier access to the cold leg side of the tubes when maintenance is required.

We claim:

1. An improved heat exchanger of the type that utilizes a primary heated fluid to heat a secondary fluid to its boiling point and which includes a shell portion having a lower and an upper end, a means for forming an annular flow path along said shell portion, a bundle of elongated and substantially parallel heat exchanger tubes disposed in thermal communication with said secondary fluid through which a flow of heated primary fluid flows, said bundle including a group of cooler heat exchanger tubes and a group of hotter heat exchanger tubes, a tubesheet mounted at said lower end of the shell portion and sealingly mounted around the ends of said heat exchanger tubes, and an inlet nozzle mounted in said shell portion for admitting a flow of secondary fluid at said group of cooler heat exchanger tubes in a direction transverse to the longitudinal axes of said heat exchanger tubes, wherein the improvement comprises a preheater assembly for redirecting the transverse flow of secondary fluid from the inlet nozzle to a flow that is continuously axially directed with respect to said tubes such that cross flow currents against said tubes are substantially prevented, said preheater assembly including a flow inlet box means located at said lower end of the shell portion and disposed around said inlet nozzle for transversely dispersing said flow of said secondary fluid from said nozzle over a greater area than the flow area of the inlet nozzle into said preheater assembly, a partition means for continuously directing the transverse flow of secondary fluid from said flow inlet box means along an axial direction with respect to said tubes for a distance sufficient to cause said secondary fluid to substantially reach its boiling point temperature within the heat exchanger, and a space between said flow inlet box means and said partition means defining a substantially unobstructed axial flow path for said secondary fluid, wherein said flow inlet box means further serves to disperse said secondary fluid away from said tubesheet to avoid thermal shock in said tubesheet.

2. An improved heat exchanger as set forth in claim 1, wherein said means for forming an annular flow path includes a wrapper for enclosing said secondary fluid generally dispersed within said shell portion.

3. An improved heat exchanger as set forth in claim 1, wherein said flow inlet box means extends within said annular flow path to an angle sufficient to encompass a majority of said group of cooler heat exchanger tubes.

4. An improved heat exchanger as set forth in claim 3, wherein said flow inlet box means extends within said annular flow path to an angle which is not less than 90 degrees and not more than 180 degrees to encompass said group of cooler heat exchanger tubes.

5. An improved heat exchanger as set forth in claim 3 wherein said flow inlet box means includes a first and a second perforated plate wherein said first perforated plate extends across said flow inlet box means and substantially restricts the flow of said secondary fluid to evenly distribute said secondary fluid within the entire angular extent of said flow inlet box means and said second perforated plate distributes the flow of said secondary fluid exiting said flow inlet box means into a plurality of diffused jets.

6. An improved heat exchanger as set forth in claim 5, wherein the porosity of said first perforated plate is approximately 5% and the porosity of said second perforated plate is approximately 50%.

7. An improved heat exchanger as defined in amended claim 1, wherein said heat exchanger includes at least one tube support plate for supporting heat exchanger tubes located in the space between said flow inlet box means and said partition means, and wherein said preheater assembly further comprises a plurality of flow holes in said plate for defining a plurality of axial flow paths for said secondary fluid.

8. An improved heat exchanger of the type that utilizes a primary heated fluid to heat a secondary fluid to its boiling point and which includes a shell portion for enclosing said secondary fluid, a bundle of substantially parallel, elongated heat exchanger tubes disposed in thermal communication with said secondary fluid through which a flow of heated primary fluid flows, said bundle including a group of cooler heat exchanger tubes and a group of hotter heat exchanger tubes, a tubesheet mounted on one end of the shell portion and sealingly mounted around the ends of said heat exchanger tubes, at least one foraminous tube support plate located within said shell portion and an inlet nozzle mounted in said shell portion in the vicinity of said tubesheet for admitting a flow of secondary fluid at said group of cooler heat exchanger tubes that is transversely oriented with respect to the longitudinal axes of said tubes, wherein the improvement comprises a preheater assembly disposed within said shell portion for redirecting said transverse flow of secondary fluid into a flow that is parallel to the longitudinal axes of said group of cooler heat exchanger tubes such that cross flow currents against said tubes are substantially eliminated, said preheater assembly including a flow inlet box means located around said inlet nozzle for transversely dispersing said flow of secondary fluid over an area that is greater than the flow area of the inlet nozzle into said preheater assembly, and a plurality of partition means separating said group of cooler heat exchanger tubes from said hotter heat exchanger tubes for continuously directing the transverse flow of secondary fluid from said flow inlet box means along the axes of said tubes for a sufficient distance within said shell portion for said secondary fluid to approach its boiling point temperature, and a space between said flow inlet box means and said plurality of partition means defining a plurality of substantially unobstructed flow paths for said secondary fluid, wherein said flow inlet ..box means further functions to disperse said transverse flow of secondary fluid away from said tubesheet to avoid thermal shock in said tubesheet.

9. An improved heat exchanger as set forth in claim 8, wherein said tubesheet and said inlet nozzle are disposed adjacent the lower end of said shell portion.

10. An improved heat exchanger as set forth in claim 9, wherein said heat exchanger includes a plurality of tube support plates and further includes a wrapper generally encasing said bundle and providing an outer boundary for said tube support plates to form an annular flow path between said wrapper and said shell portion.

11. An improved heat exchanger as set forth in claim 10 wherein said tube support plates are circular having a diameter equal to the width of said wrapper and said partition means are panels positioned perpendicular to said tube support plates and extending the entire diameter of said circular tube support plate to radially define said preheater assembly within said group of cooler heat exchanger tubes.

12. An improved heat exchanger as set forth in claim 11, wherein said tube support plates include a top and a bottom portion which include radially extending slots located thereon and said partition means include key extensions on opposite ends thereof to be matingly received by said slots of said tube support plates.

13. An improved heat exchanger as set forth in claim 10, wherein said tube support plates further include tube holes to permit axial flow of said secondary fluid therethrough.

14. An improved heat exchanger as set forth in claim 13, wherein a lower tube support plate located below said inlet nozzle and above said tubesheet includes tube holes which are sufficiently small to permit only a minority of flow therethrough to force the majority of flow of said secondary fluid upward axially through said preheater assembly.

15. An improved heat exchanger as set forth in claim 14, further including a flow distribution baffle wherein said lower tube support plate and said tubesheet define a space sufficient for placement of said flow distribution baffle therebetween.

16. An improved heat exchanger as set forth in claim 15, further including a blowdown inlet wherein said flow distribution baffle is designed to direct a slow flow zone at a central location of said tubesheet so that said blowdown inlet may be located at said central location between said hotter heat exchanger tubes and said cooler heat exchanger tubes.

17. An improved heat exchanger as set forth in claim 8, wherein said flow inlet box means extends within said annular flow path to an angle sufficient to encompass a majority of said group of cooler heat exchanger tubes.

18. An improved heat exchanger as set forth in claim 17, wherein said flow inlet box means includes a perforated plate and a channeling separation means for channeling said transversely oriented flow into at least two substantially equal flow paths across said perforated plate.

19. An improved heat exchanger as set forth in claim 17, wherein said annular flow path includes recirculating fluid which flows into said shell portion, over said tubesheet and below said flow inlet box means which is warmer than said secondary fluid to substantially prevent said secondary fluid entering said shell portion from contacting said tubesheet.

20. An improved heat exchanger as set forth in claim 19, wherein said flow inlet box means extends within said annular flow path to an angle which is not less than 90 degrees and not more than 180 degrees to encompass said group of cooler heat exchanger tubes.

21. An improved heat exchanger as set forth in claim 20, wherein said flow inlet box means includes a first and a second perforated plate wherein said first perforated plate extends across said flow inlet box means and substantially restricts the flow of said secondary fluid to evenly distribute said secondary fluid within the entire angular extent of said flow inlet box means and said second perforated plate distributes the flow of said secondary fluid exiting said flow inlet box means into a plurality of diffused jets.

22. An improved heat exchanger of the type including a shell portion, and a plurality of elongated and substantially parallel heat exchanger tubes that includes a group of cooler heat exchanger tubes and a group of hotter heat exchanger tubes, a tubesheet mounted on one end of the shell portion and sealingly mounted around the ends of the heat exchanger tubes; and an inlet nozzle for admitting a transversely directed flow of fluid into said group of cooler heat exchanger tubes, wherein the improvement comprises a preheater assembly for redirecting the transverse flow of fluid from the inlet nozzle to a flow that is continuously axially directed with respect to said tubes such that cross flow currents against said tubes are substantially prevented, said preheater assembly including a flow inlet box means disposed around said inlet nozzle for transversely dispersing said flow of secondary fluid over a greater area than the flow area of the nozzle into said preheater assembly, and a partition means disposed between said cooler and hotter groups of heat exchanger tubes, and a space between said flow inlet box means and said partition means for defining at least one substantially unobstructed axial flow path for said secondary fluid, wherein said flow inlet box means further functions to disperse said transverse flow away from the tubesheet to avoid thermal shock to the tubesheet.

* * * * *